United States Patent [19]

McCain

[11] Patent Number: 4,545,579

[45] Date of Patent: Oct. 8, 1985

[54] GOLF CLUB AND GOLF CLUB SUPPORT

[76] Inventor: Iona I. McCain, 40 South Lassen St., Susanville, Calif. 96130

[21] Appl. No.: 678,980

[22] Filed: Dec. 6, 1984

Related U.S. Application Data

[63] Continuation-in-part of Ser. No. 587,662, Mar. 8, 1984.

[51] Int. Cl.[4] ..... A63B 55/10

[52] U.S. Cl. ..... 273/162 R; 273/32 R

[58] Field of Search ..... 273/162 R, 162 B, 162 F, 273/194 R, 68, 26 B, 72 R, 72 A, 32 B

[56] References Cited

U.S. PATENT DOCUMENTS

| | | | |
|---|---|---|---|
| 2,482,015 | 9/1949 | McConnell | 273/194 R |
| 2,506,981 | 10/1950 | Von Beck | 248/38 |
| 3,408,075 | 10/1968 | Colton | 273/194 R X |
| 4,063,731 | 12/1977 | Kitay | 273/32 B |
| 4,210,334 | 7/1980 | Lind | 273/162 R |
| 4,239,227 | 12/1980 | Davis | 273/194 R X |

*Primary Examiner*—William H. Grieb

*Attorney, Agent, or Firm*—Leonard D. Schappert

[57] ABSTRACT

A golf club and golf club support including support means for holding the golf club handle high enough above the ground to keep the grip clean and dry when the golf club is laid down in the course of a game of golf.

2 Claims, 6 Drawing Figures

GOLF CLUB AND GOLF CLUB SUPPORT

CROSS-REFERENCE TO RELATED APPLICATION

This is a continuation-in-part application of pending prior application Ser. No. 587,662, filed on Mar. 8, 1984, of IONA IRELAND McCAIN for GOLF CLUB AND GOLF CLUB SUPPORT.

BACKGROUND OF THE INVENTION

1. Field of the Invention

This invention relates generally to the game of golf, and more specifically to golf clubs and means used for holding a golf club handle sufficiently far above the ground so that it does not get wet or dirty when the golf club is set down.

2. Description of the Prior Art

In the past, inventors have directed their efforts toward golf clubs with improved grips and a combination golf tool designed to hold a golf club handle above the ground and including other features for assisting golfers. Applicant is unaware of any prior art which teaches a golf club and golf club stand or support having the unique features and advantages evident in the present invention.

SUMMARY OF THE INVENTION

The present invention consists of a golf club and a golf club support which is designed to slide onto the handle of a golf club to a position near the grip and to hold the grip of the golf club far enough above the ground to keep it dry and clean when the golf club is laid down on the ground. The invention includes means of attaching the golf club support to the handle of a golf club and movable support means which pivot with respect to the attaching means. The golf club support is further lockable in a closed position on the golf club handle or in its open supporting position.

One of the objects of the present invention is to provide a golf club support which holds the handle of a golf club above the ground, thereby keeping it dry and clean.

Another object of the present invention is to provide a golf club support which is relatively inexpensive and easy to build.

A further object of the present invention is to provide a golf club support which does not appreciably affect the aerodynamics of the golf club, so that it may be left on the handle of the golf club at all times.

A further object of the present invention is to provide a golf club support which locks in position on the golf club during the swing so that it does not interfere with or affect the swing of the golfer.

A further object of the present invention is to provide a golf club having the unique features set out in the foregoing summary.

The foregoing objects, as well as numerous other objects, are made more apparent by the drawings, descriptions and claims which follow.

DESCRIPTION OF THE PREFERRED EMBODIMENT

Figure 1:
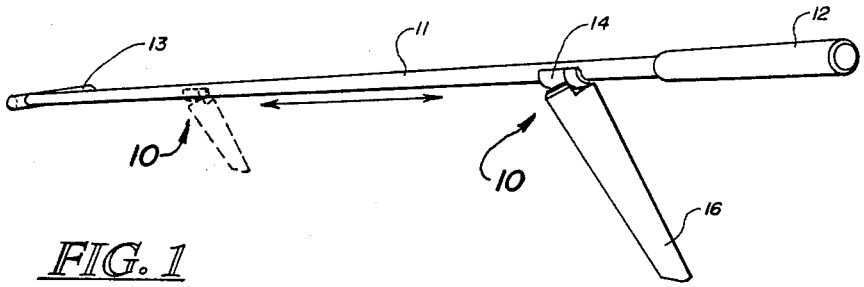
FIG. 1 is a perspective view showing the golf club support in a supporting position on a golf club handle.

FIG. 1 shows the golf club support 10 in position on and supporting golf club handle 11, thereby keeping grip 12 of the golf club above the ground and clean and dry. When stationary section 14 of golf club support 10 is first attached to handle 11, it is slid up the golf club handle 11, as shown by the dashed line and arrow, until it is snugly attached to golf club handle 11, and is positioned as shown, so that support section 16 is at a substantially right angle to golf club head 13 when supporting the golf club. This is required for balancing golf club handle 11 on support section 16. Because the diameter of a golf club handle is tapered, stationary section 14 slips onto the lower end of golf club handle 11 as shown in FIG. 1, but is held tightly in place by friction after having been slid toward grip 12 and the large-diameter portion of golf club handle 11.

Figure 2:
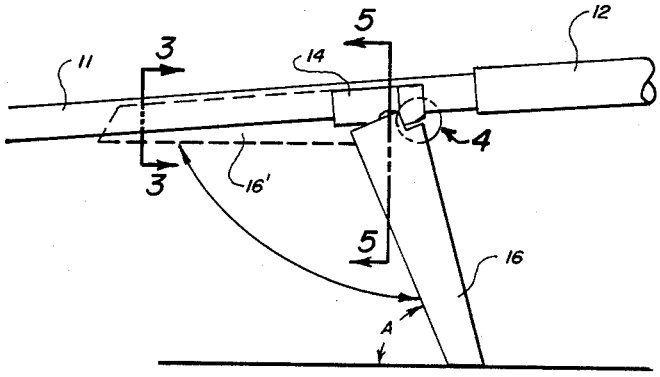
FIG. 2 is a side view of the invention in position on a golf club handle, specifically showing its features.
Figure 3:
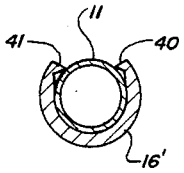
FIG. 3 is a cross-sectional view taken along lines 3—3 of FIG. 2, and showing the shape of the support portion of the golf club support.

FIG. 2 shows golf club support 10 in position on golf club handle 11 in greater detail. The operator positions stationary section 14 securely on golf club handle 11 by sliding it up golf club handle 11 as shown in FIG. 1. Support section 16 is attached to stationary section 14 by pivot means 17 and 20, and it pivots with respect to stationary section 14 and golf club handle 11 as shown by the movement arrow in FIG. 2. When it is needed to support golf club handle 11, support section 16 is pivoted outward from stationary section 14 at an angle slightly in excess of 90 degrees and locked in that position. When not in use, support section 16 is locked in a closed position on golf club handle 11, as shown by dashed lines designated 16'. Support section 16 is conical in nature, and as shown in FIG. 3 of the drawings, it wraps slightly and fits snugly around golf club handle 11 with lips 40 and 41, which hold it in position with respect to golf club handle 11. This is the preferred method of securing it against golf club handle 11.

Angle A is predetermined and is such that, when golf club support 10 is in place on and supporting golf club handle 11, the end of support section 16 is substantially flat with respect to the ground. The specific angle chosen for "A" is determined by the length of golf club handle 11, the position of golf club support 10 on golf club handle 11, and the length of support section 16.

Figure 4:
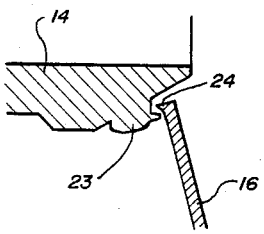
FIG. 4 is an expanded cross-sectional view of the area circled in FIG. 2 showing more particularly the feature which locks the support section in place.

Means for locking support section 16 in a supporting position with respect to stationary section 14 are shown in FIG. 4. Specifically, stationary section 14 has an extension 23, the position and shape of which is such that a detent is formed which catches edge 24 of support section 16, holding it in an open supporting position with respect to stationary section 14.

Figure 5:
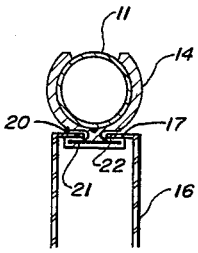
FIG. 5 is a cross-sectional view of the invention taken along lines 5—5 of FIG. 2 and showing the physical construction of the invention in more detail.

FIG. 5 of the drawings is a cross-sectional view of stationary section 14 and support section 16 taken along lines 5—5 of FIG. 2. Stationary section 14 is semicylindrical in nature and slides onto golf club handle 11 as shown in FIG. 1. It is held in place with respect to golf club handle 11 by its own tension, or by adhesive material, or by both. Pivot means 17 and 20, upon which support section 16 pivots, as well as holes 21 and 22 in which they are set, are also shown in greater detail.

Figure 6:
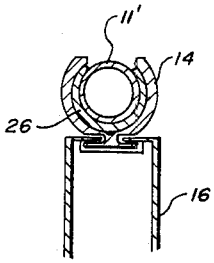
FIG. 6 is a cross-sectional view of the invention taken along lines 5—5 of FIG. 2 and showing the device of FIG. 5, but with an adjustment insert added.

FIG. 6 of the drawings is a cross-sectional view of stationary section 14 and support section 16 taken along lines 5—5 of FIG. 2 and showing insert 26, which is positioned between golf club handle 11 and stationary section 14. The purpose of insert 26 is to adapt golf club support 10 to fit golf clubs with handles of smaller diameters.

All parts of golf club support 10 are here constructed of plastic, but could as well be constructed of any appropriate materials.

In practice, stationary section 14 slides from the lower part onto the upper part of golf club handle 11 as shown in FIG. 1 and is set into position so that, when support section 16 is in an open supporting position, it is set at a substantially right angle to golf club head 13. When locked in a support position, support section 16 holds golf club handle 11 high enough above the ground to keep golf club grip 12 dry and clean when the golf club is lying on the ground. Because of the large end area of support section 16, support section 16 does not penetrate the ground appreciably, but holds grip 12 above the ground. During use of the golf club, support section 16 pivots and swings into and against golf club handle 11, locking with respect thereto as previously discussed. Because it is held in tightly against golf club handle 11, support section 16 does not appreciably affect the aerodynamics of the golf club and the swing of the golfer.

While such is not specifically shown here, it is anticipated that the golf club support could be constructed as an integral part of the golf club handle and/or as an integral part of the golf club grip.

While the foregoing description of the invention has shown a preferred embodiment using specific terms, such description is for illustrative purposes only. It is applicant's intention that changes and variations may be made without departure from the spirit or scope of the following claims, and this disclosure is not intended to limit applicant's protection in any way.

I claim:

1. A golf club support for use with a golf club having a shaft of varying diameter near its grip and a smaller diameter near its head, comprising:

a stationary section consisting of a substantially rigid semicylindrical sleeve having a concave inner surface with a diameter which is smaller than said larger diameter of said shaft, further having a section of its wall removed whereby said stationary section slips over said smaller diameter of said shaft and slides to said larger diameter of said shaft to a position where said shaft and said inner surface interfere with each other, thereby holding said stationary section tightly on said shaft, and including a detent, and a support section consisting of a substantially conically-shaped hollow sleeve which is pivotally attached to said stationary section by pivot means whereby said support section pivots with respect to said stationary section and which has a substantially conically-shaped inner surface the smallest diameter of which is smaller than said larger diameter of said shaft, further having a section of its wall removed and having lips there attached so that said support section is held tightly against said shaft by said lips when it is positioned against said shaft, further having an edge which locks against said detent of said stationary section whereby said support section is locked into place with respect to said stationary section when it is pivoted into an open, supporting position.

2. The invention of claim 1, including a semicylindrical insert for adapting said golf club support for use with golf clubs having shafts said larger diameter of which is smaller than said diameter of said concave inner surface of said stationary section.

* * * * *